US007100764B2

(12) United States Patent
Focke

(10) Patent No.: US 7,100,764 B2
(45) Date of Patent: Sep. 5, 2006

(54) BOX PACKAGING FOR CIGARETTES

(75) Inventor: Heinz Focke, Verden (DE)

(73) Assignee: Focke & Co. (GmbH & Co.), (DE)

( * ) Notice: Subject to any disclaimer, the term of this patent is extended or adjusted under 35 U.S.C. 154(b) by 0 days.

(21) Appl. No.: 10/130,446

(22) PCT Filed: May 2, 2001

(86) PCT No.: PCT/EP01/04910

§ 371 (c)(1),
(2), (4) Date: May 16, 2002

(87) PCT Pub. No.: WO01/89961

PCT Pub. Date: Nov. 29, 2001

(65) Prior Publication Data

US 2003/0019768 A1 Jan. 30, 2003

(51) Int. Cl.
*B65D 85/10* (2006.01)

(52) U.S. Cl. ..... 206/273; 206/526; 206/264

(58) Field of Classification Search ..... 206/264, 206/273, 770, 778, 775, 526; 229/87.13, 229/904, 904.1
See application file for complete search history.

(56) References Cited

U.S. PATENT DOCUMENTS 2,548,985 A * 4/1951 Lighter ..... 206/782
3,063,553 A * 11/1962 Nicholson ..... 206/273
3,071,244 A * 1/1963 Doran ..... 206/45.29
4,406,364 A * 9/1983 Bronander, Jr. ..... 206/77.1
4,738,359 A * 4/1988 Phillips, Jr. ..... 206/256
4,784,261 A * 11/1988 Kutchin ..... 206/256
5,207,326 A * 5/1993 Benach ..... 206/424
6,234,943 B1 5/2001 Copin

FOREIGN PATENT DOCUMENTS

| | | |
|---|---|---|
| CA | 2253134 | 12/1999 |
| DE | 2804370 A1 | 8/1979 |
| DE | 4310646 A1 | 10/1994 |
| EP | 0835748 A1 | 4/1998 |
| EP | 1173371 B1 | 2/2000 |
| GB | 2013607 A | 8/1979 |
| GB | 2337034 A | 11/1999 |

OTHER PUBLICATIONS

Copy of "TORTA Research S.r.1." search report prepared fof the European Patent Office on parent European patent application, dated Oct. 13, 2003.

* cited by examiner

*Primary Examiner*—David T. Fidei
(74) *Attorney, Agent, or Firm*—Laurence P. Colton; Powell Goldstein LLP

(57) ABSTRACT

Multipack for a group of cigarette packs (10) that are arranged in two rows and are enclosed by a multipack blank (11) made of thin cardboard. The multipack blank (11) is designed and folded such that a top side (12) is free and it is possible to see the cigarette packs (10) positioned therein. The pack unit is enclosed by an outer wrapper (22) made of transparent or see-through film with a tear-open strip (23).

3 Claims, 6 Drawing Sheets

BOX PACKAGING FOR CIGARETTES

BACKGROUND OF THE INVENTION

1. Technical Field.

The invention relates to a multipack for cigarettes—generally termed a cigarette multipack herein—for a group of cigarette packs arranged in rows, said group being enclosed by a multipack blank made of thin cardboard.

2. Prior Art.

Multipacks for cigarettes, that is to say so-called cigarette multipacks, constitute packaging units that are commonly provided throughout the world for both consumers and retailers. A multipack usually comprises ten cigarette packs, which are mostly formed in two rows of five packs each. The two rows of packs have their large surfaces (front side and rear side) butting against one another.

The object of the invention is to propose a multipack for cigarettes which ensures easier handling—for the removal of the cigarette packs—has a relatively small material consumption and, furthermore, ensures that the pack contents are presented to better effect.

BRIEF SUMMARY OF THE INVENTION

In order to achieve this object, the multipack according to the invention is characterized by the following features:

a) the group of cigarette packs is open on at least one large-surface-area side, that is to say it is not, or predominantly not, covered by the multipack blank,
b) the cigarette packs are arranged such that a large-surface-area front side of the same is positioned in the region of the open side of the multipack blank, and
c) the unit comprising the cigarette packs and the multipack blank is fully enclosed by an outer wrapper made of transparent material, namely by a cellophane or plastic film.

Accordingly, in the case of the multipack according to the invention, the multipack blank is designed such that a preferably large-surface-area front wall is completely, or more or less completely, absent, with the result that the cigarette packs are exposed in this region. These packs are positioned such that, in the region of the open pack side, the front surfaces of the cigarette packs, that is to say the specifically configured visible surfaces, are exposed and are thus directly visible. The consumer can thus see the contents of the multipack directly. Nevertheless, the outer film wrapper ensures that the multipack remains a closed unit.

For production reasons, but also for presentation reasons, the multipack blank, according to a further feature of the invention, may be configured such that a border strip is provided preferably on one side in the region of the open front side of the multipack. The configuration of this border strip may correspond to the shape and/or the configuration of the front side of the cigarette packs.

Further details and features of the cigarette multipack according to the invention are explained more specifically hereinbelow with reference to exemplary embodiments illustrated in the drawings, in which like reference numerals designate like parts throughout the several views.

DETAILED DESCRIPTION OF THE PREFERRED EMBODIMENTS

The drawings relate to multipacks for cigarettes, that is to say to so-called cigarette multipacks. A group of cigarette packs 10 is enclosed by a multipack blank 11. The multipack blank consists of a strong but foldable material, in particular of thin cardboard.

Figure 1:
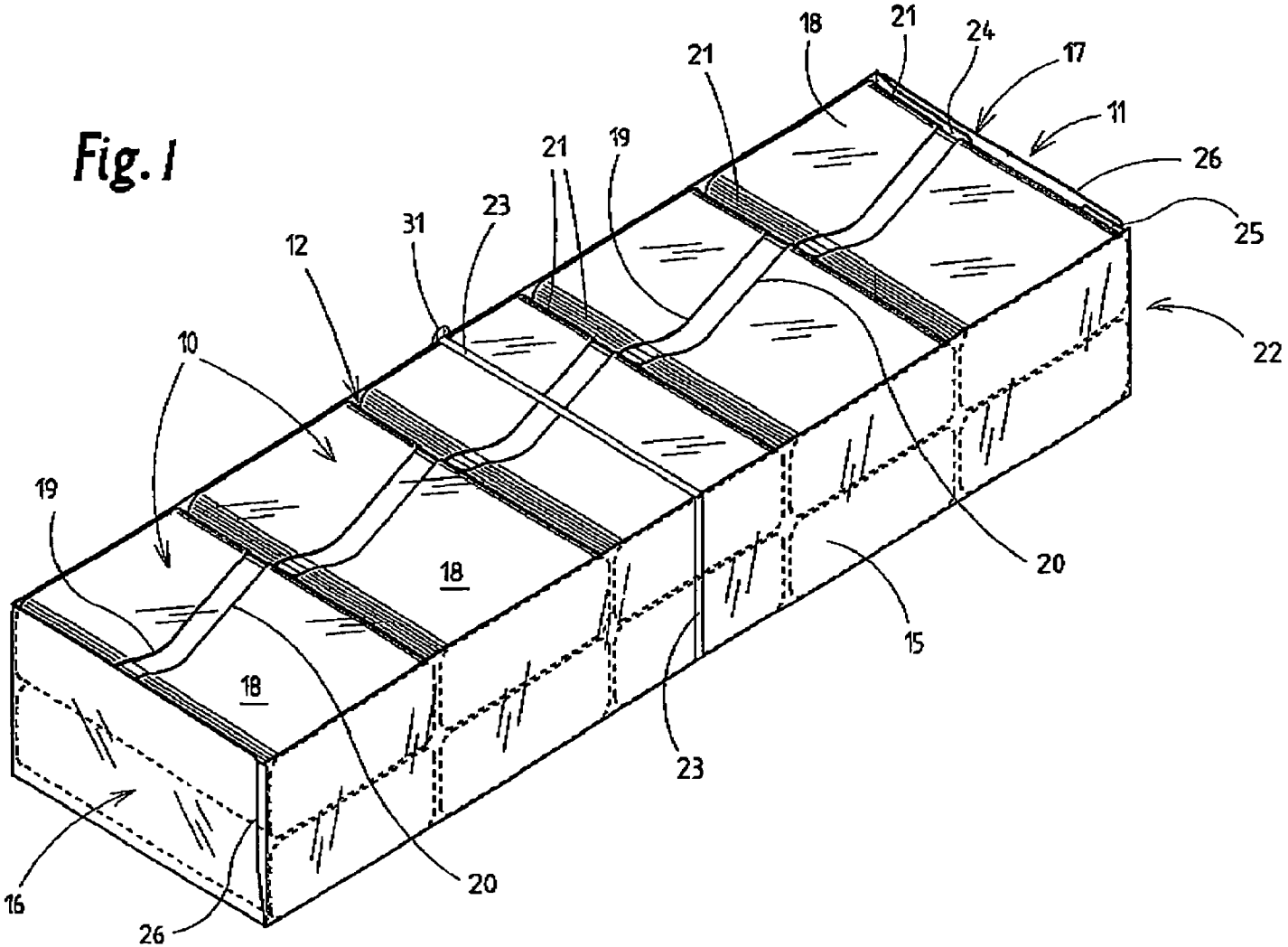
FIG. 1 shows a perspective view of a multipack for cigarettes.
Figure 2:
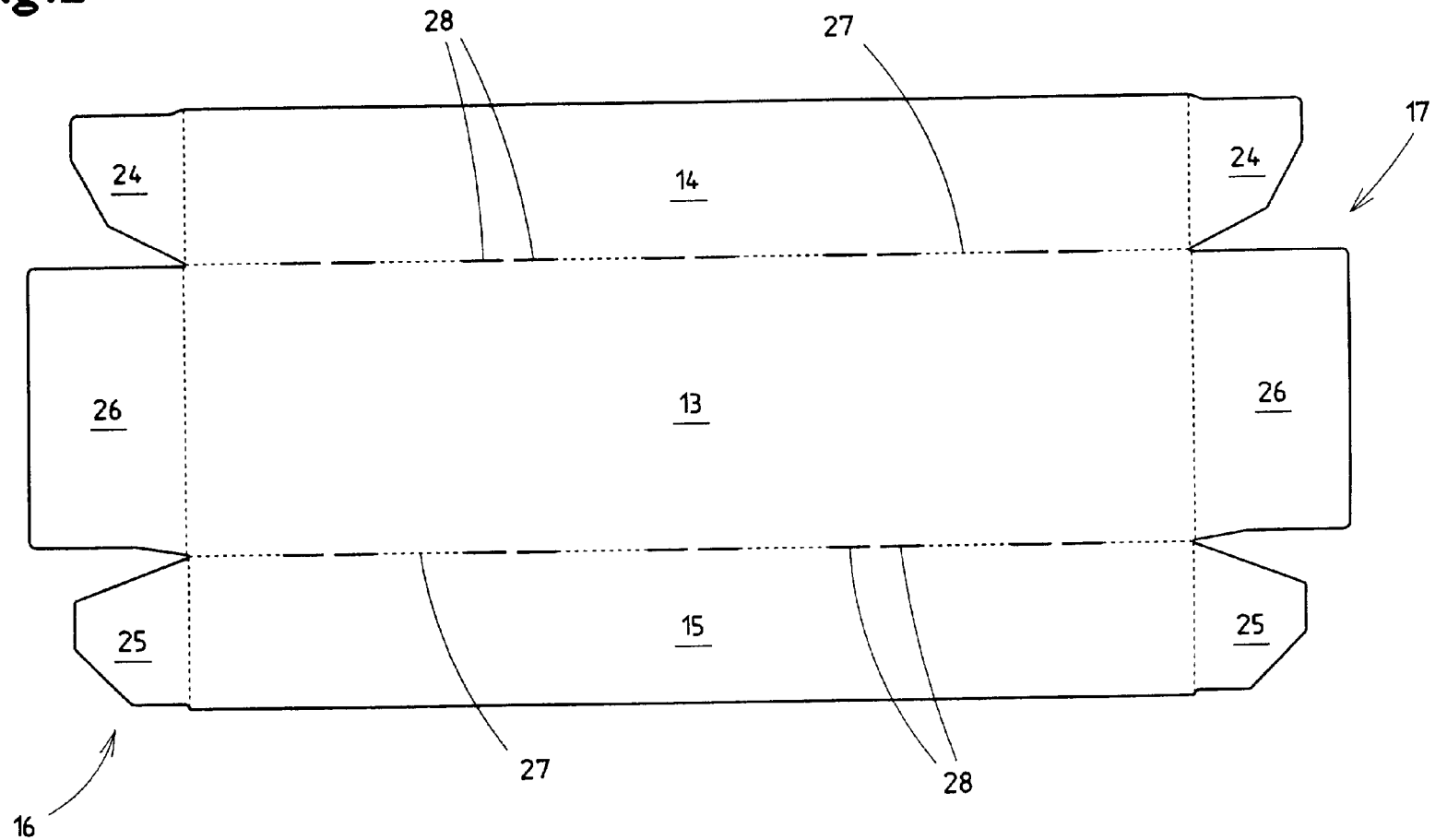
FIG. 2 shows a spread-out multipack blank for a multipack according to FIG. 1.

For the exemplary embodiment of FIG. 1, the multipack blank is designed (FIG. 2) and folded such that a large-surface-area side of the multipack, namely a top side 12, is free or open. The pack contents—the group of cigarette packs 10—are merely enclosed by a base wall 13, two elongate side walls 14, 15 and two small-surface-area end walls 16, 17. The cigarette packs 10 are free or uncovered in the region of the open top side 12.

The cigarette packs 10 are positioned within the multipack, or the multipack blank 11, in a formed group, to be precise in two rows, of which the top row in FIG. 1 is visible in the region of the top side 12. Within the row, the cigarette packs 10 have their narrow side surfaces butting against one another. A front side 18 of the cigarette packs of the top row is directed toward the top side 12, that is to say it is exposed and thus visible.

In the case of the exemplary embodiment shown, the front side 18 of the cigarette packs 10 is configured specifically, namely with curved closing edges 19 and 20 belonging to a lid and a box part. The closing edges 19, 20 are spaced apart and run parallel to one another. A subregion of a collar arranged within the cigarette pack 10 is visible between the closing edges 19, 20. Furthermore, the cigarette packs are designed with rounded, lateral pack edges, that is to say with round edges 21. On account of the design of the multipack or of the multipack blank 11, this configuration of the cigarette packs 10 can be seen freely from the outside.

The unit comprising the cigarette packs 10 and the multipack blank 11 is enclosed by an outer wrapper 22. The latter consists of a transparent or see-through film, such as cellophane or plastic. The outer wrapper 22 preferably fully encloses the multipack, that is to say it encloses it in the region of all sides. Overlapping folding tabs of the outer wrapper 22 are connected to one another in a known manner by adhesive bonding or by heat sealing.

For the purpose of opening the multipack, the outer wrapper 22 is provided with an opening aid, to be precise with a tear-open strip 23 running all the way around. In the present case, this is arranged in the longitudinal center of the elongate, cuboidal multipack, with the result that opening the tear-open strip 23 running all the way around—with the aid of an exposed grip end 31—produces two approximately equally sized subregions of the outer wrapper 22, which can easily be removed from the pack. The tear-open strip 23 may also be positioned eccentrically, for example such that a "cap" of the outer wrapper 22 can be removed once the tear-open strip 23 has been removed.

For the purpose of forming the end walls 16, 17, the multipack blank 11 is provided with inner tabs 24, 25, which are provided in extension of the side walls 14, 15. A rectangular cover tab 26 is located in the region of the base wall 13. This cover tab forms the outside of the end wall 16, 17 and extends approximately over the entire surface area of the same.

Folding lines 27 for separating off the base wall 13 from the side walls 14, 15 are provided with punched cuts 28, which facilitate the folding operation when the group of cigarette packs 10 are wrapped.

Figure 3:
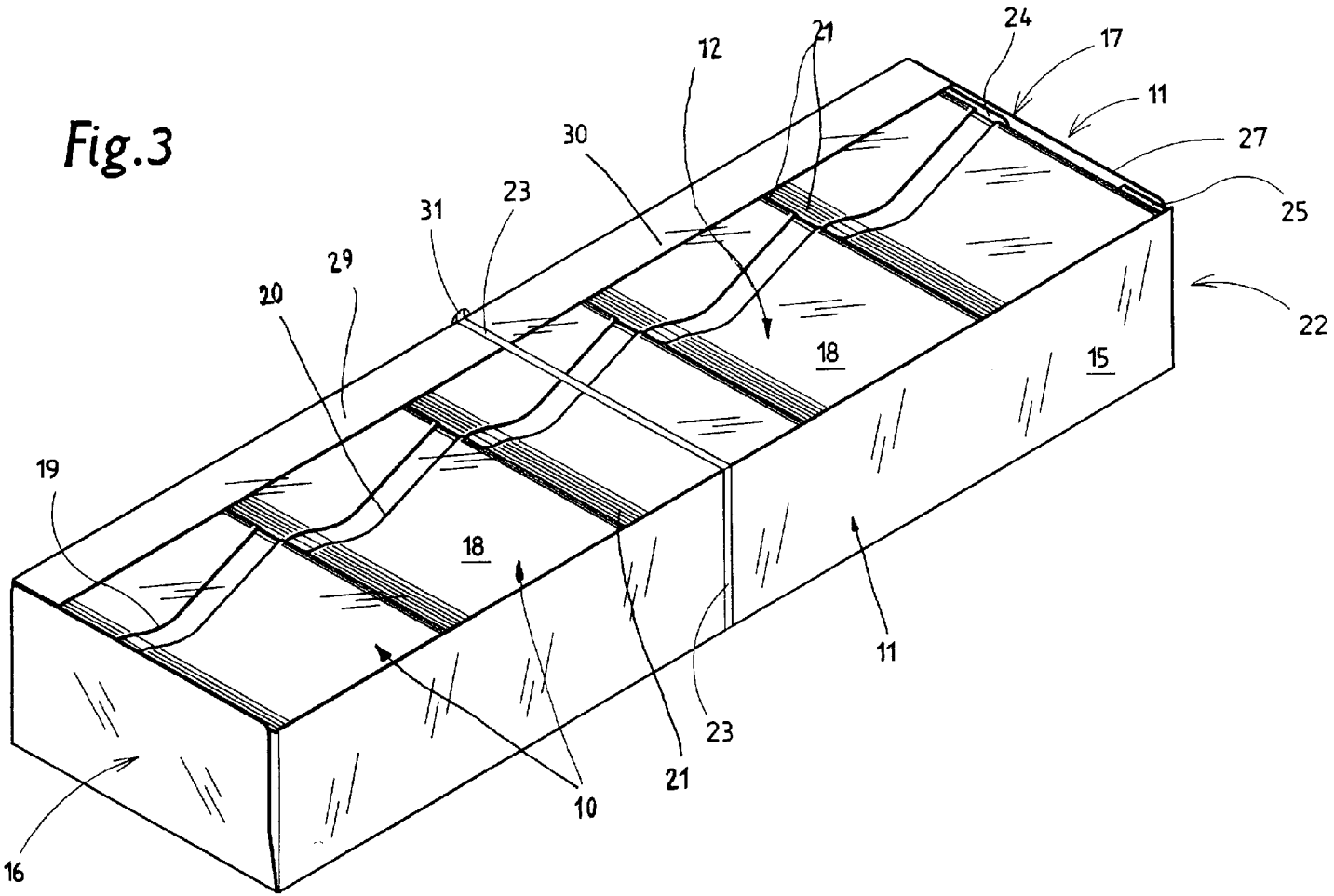
FIG. 3 shows, in an illustration corresponding to FIG. 1, another embodiment of a multipack.
Figure 4:
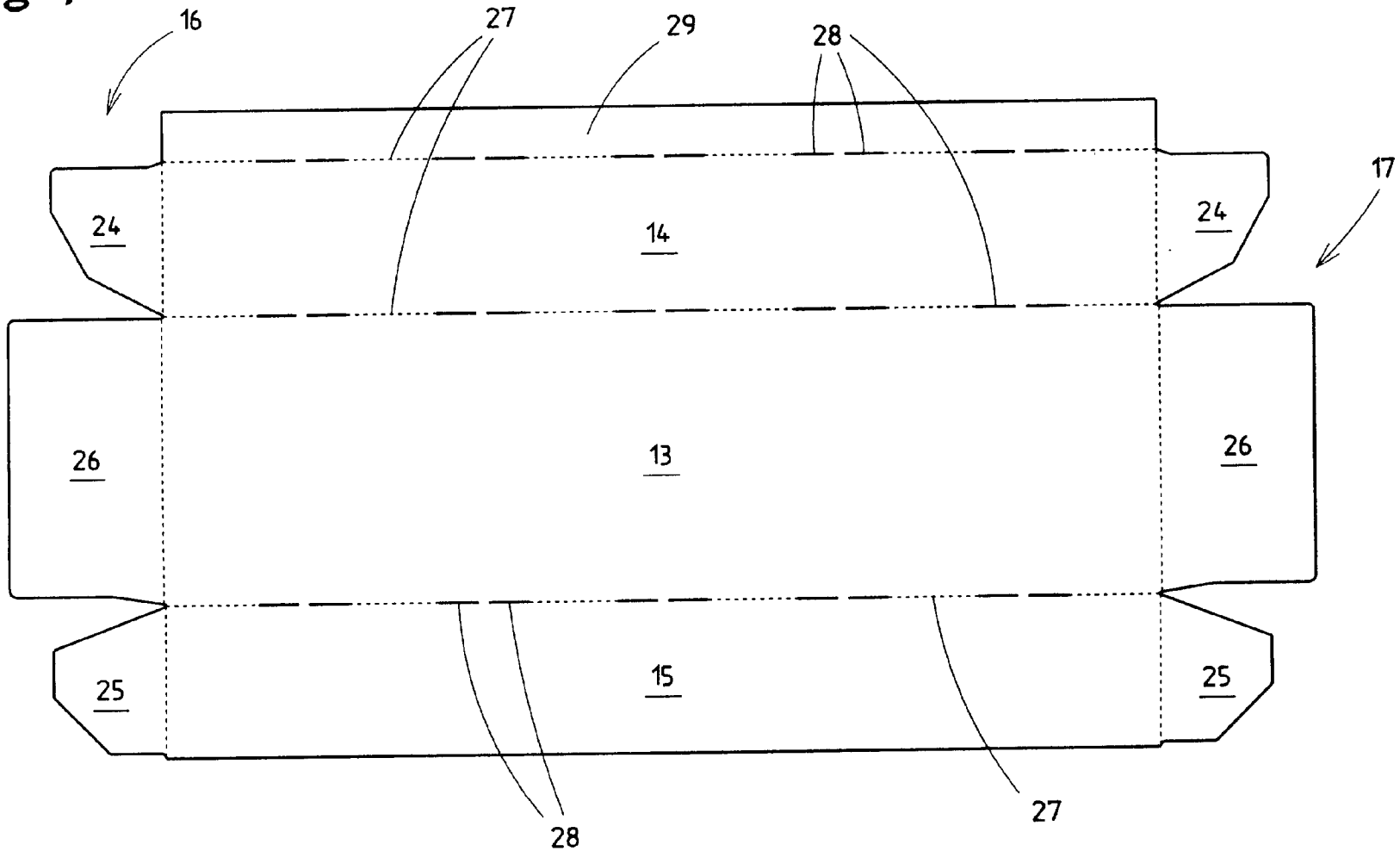
FIG. 4 shows a spread-out multipack blank for a multipack according to FIG. 3.

The exemplary embodiment according to FIGS. 3 and 4 differs from that described above in that the open side of the multipack, that is to say the top side 12, has a border strip 29 at one border. This border strip extends in the region of the open top side 12, over the entire length of the same. The border strip 29 makes it easier for the group of cigarette packs 10 to be wrapped by the multipack blank 11 and, furthermore, is suitable for carrying decorative printing and/or printed information. The border strip 29 is not connected to the end walls 16, 17. The border strip 29 is held in abutment against the cigarette packs 10, or the front sides 18 thereof, by the outer wrapper 22. The border strip 29 can be moved freely once the outer wrapper 22 has been removed.

Figure 5:
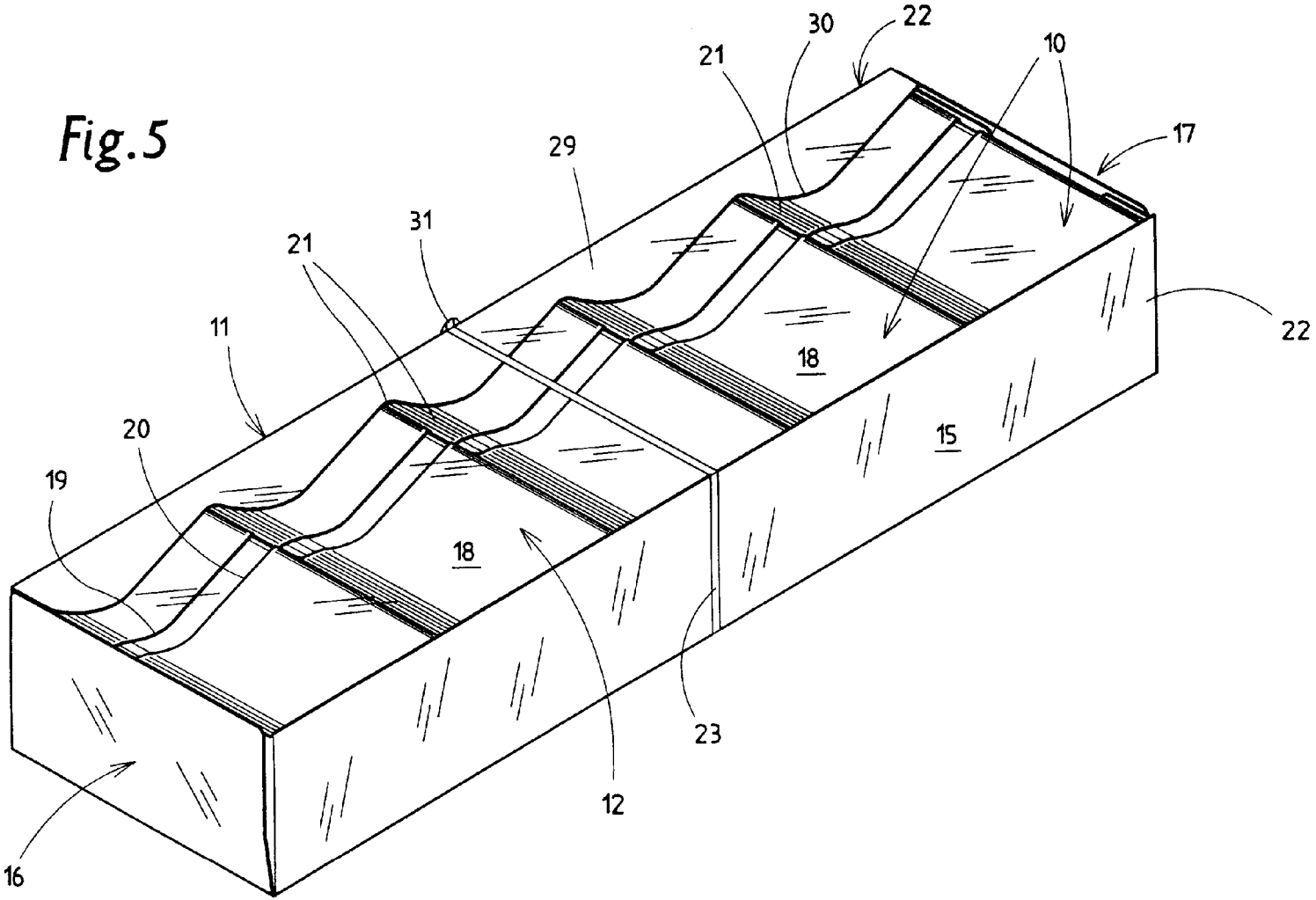
FIG. 5 shows a perspective view of a third exemplary embodiment of a multipack.
Figure 6:
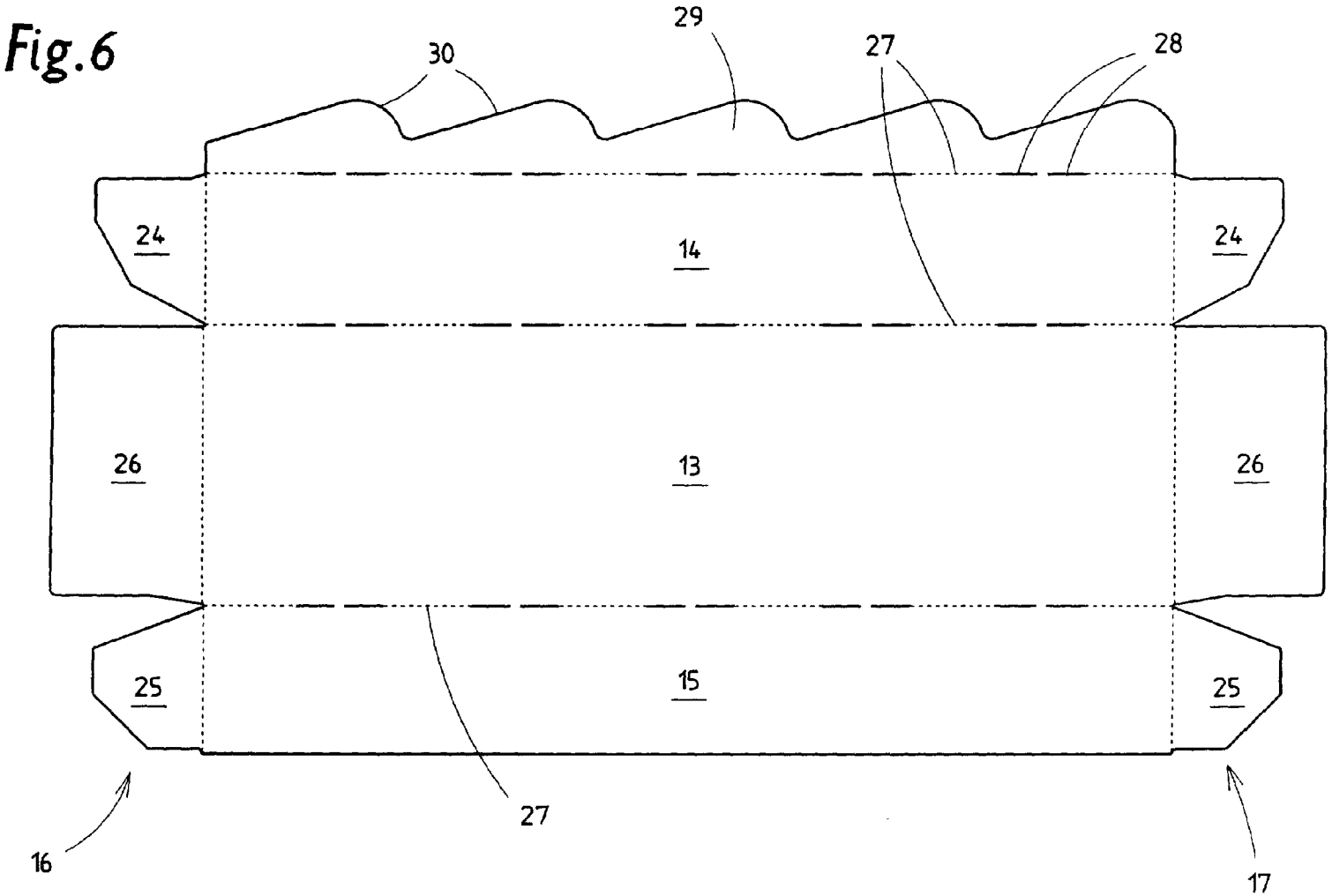
FIG. 6 shows a multipack blank for a pack according to FIG. 5.

In the case of the exemplary embodiment according to FIGS. 5 and 6, a specifically configured border strip 29, namely with a contoured border edge 30, is provided. In the present case, said border edge is of approximately undulating design and is adapted to the design of the front sides 18 of the cigarette packs 10, namely to the configuration of the closing edge 19, 20.

By virtue of the multipack blank 11 interacting with the outer wrapper 22, the multipack described ensures a large stable and closed pack for cigarette packs. The folding tabs of the end walls 16, 17 are connected to one another, in particular by adhesive bonding, with the result that the dimensional stability of the multipack, which is open on one side, is ensured.

LIST OF DESIGNATIONS

10 Cigarette pack
11 Multipack blank
12 Top side
13 Base wall
14 Side wall
15 Side wall
16 End wall
17 End wall
18 Front side
19 Closing edge
20 Closing edge
21 Round edge
22 Outer wrapper
23 Tear-open strip
24 Inner tab
25 Inner tab
26 Cover tab
27 Folding line
28 Punched cut
29 Border strip
30 Border edge
31 Grip end

What is claimed is:

1. A multipack for a group of cigarette packs, said cigarette packs being arranged in a group having at least two rows of the cigarette packs, namely a top row and a lower row, and enclosed by a multipack blank made of thin cardboard, wherein:

a) the multipack blank consists essentially of a base wall, two narrow elongate side walls, and two end walls made from folding tabs of the multipack blank that are connected to one another by adhesive bonding;

b) when the multipack blank is formed into the multipack, the multipack is open on a top side and the end walls completely cover corresponding sides of the cigarette packs;

c) the cigarette packs are arranged within the multipack such that (i) the front sides of the cigarette packs in the top row are positioned in the region of the open top side of the multipack and are not covered by the multipack blank; (ii) the cigarette packs that are adjacent to each other in each row have narrow sides butting against one another and the cigarette packs that are in the top row have back sides butting against front sides of the respective cigarette packs in the lower row; and (iii) only the front sides of the cigarette packs of the top row are visible through the open top side of the multipack blank; and d) the cigarette packs and the multipack blank are fully enclosed by an outer wrapper made of a transparent material selected from the group consisting of plastic and cellophane.

2. The multipack as claimed in claim 1, wherein the outer wrapper has a tear-open strip that extends all the way around transversely to the base wall and to the side walls of the multipack blank.

3. The multipack as claimed in claim 2, wherein the tear-open strip extends transversely around a longitudinal center of the base wall and the side walls of the multipack blank.

* * * * *

UNITED STATES PATENT AND TRADEMARK OFFICE

CERTIFICATE OF CORRECTION

PATENT NO. : 7,100,764 B2
APPLICATION NO. : 10/130446
DATED : September 5, 2006
INVENTOR(S) : Focke It is certified that error appears in the above-identified patent and that said Letters Patent is hereby corrected as shown below:

On Title Page Item (30), should read,
Foreign Application Priority Data

DE 100 25 062.9 (May 23, 2000)
PCT/EP01/4910 (May 2, 2001)

Signed and Sealed this

First Day of May, 2007

JON W. DUDAS
*Director of the United States Patent and Trademark Office*